United States Patent [19]

Coursen et al.

[11] 3,986,430

[45] Oct. 19, 1976

[54] LOADING OF BOREHOLES WITH EXPLOSIVES

[75] Inventors: David Linn Coursen, Mercersburg, Pa.; Edmund Joseph Osterman, Winchester, Va.

[73] Assignee: E. I. Du Pont de Nemours and Company, Wilmington, Del.

[22] Filed: Mar. 21, 1975

[21] Appl. No.: 560,712

[52] U.S. Cl. ..... 86/20 C; 102/21; 102/23; 175/1; 175/72

[51] Int. Cl.[2] ..... F42B 3/00; F42D 1/00

[58] Field of Search ..... 86/20 C; 102/20, 21, 102/23; 175/1, 72, 24, 48; 166/290, 51

[56] References Cited

UNITED STATES PATENTS

| | | | |
|---|---|---|---|
| 2,824,483 | 2/1958 | Johansson | 86/20 C |
| 3,005,373 | 10/1961 | Ranson | 86/20 C |
| 3,040,615 | 6/1962 | Johansson et al. | 86/20 C |
| 3,199,399 | 8/1965 | Gardner | 86/20 C |
| 3,361,023 | 1/1968 | Collins et al. | 86/20 C |
| 3,362,476 | 1/1968 | Van Poollen | 175/72 X |
| 3,407,886 | 10/1968 | Bennett | 175/27 |
| 3,417,824 | 12/1968 | Van Poollen | 175/72 X |

*Primary Examiner*—David H. Brown

[57] ABSTRACT

Explosive cartridges are loaded into boreholes at a rapid rate by guided descent through a retractable flexible tubing assembly through which a stream of water flows. The cartridges preferably are cut open just before their discharge from the assembly, and their passage through, or discharge from, the assembly is detected outside the borehole. The assembly is retracted incrementally until completion of the loading. Apparatus comprising a cartridge-guiding assembly through which a stream of water flows, and means associated with the assembly for sensing cartridge passage or discharge.

24 Claims, 3 Drawing Figures

LOADING OF BOREHOLES WITH EXPLOSIVES

BACKGROUND OF THE INVENTION

1. Field of the Invention

The present invention relates to a method of emplacing explosive charges in deep boreholes and to an apparatus for carrying out the method.

2. Description of the Prior Art

Processes for explosively fracturing deep rock are becoming increasingly important as it becomes necessary to tap deep mineralized rock masses in order to supplement or replace dwindling energy sources and minerals supplies. Deep-blasting processes are needed, for example, in the treatment of oil and gas wells, the preparation of metallic ores for in situ leaching, and the preparation of oil shale for retorting or solvent extraction in place. To carry out such processes it is sometimes necessary to emplace and detonate explosives in boreholes ranging in depth from seveal hundred to several thousand feet.

Conventional procedures for loading boreholes are not adequate for loading boreholes of such depth. For deep boreholes, the explosive needs to be largely in cartridged form to avoid such problems as desensitization of the explosive by water and leakage of the explosive through fissures in the surrounding rock. Because deep holes are apt to be flooded with water, explosives which do not have good water resistance must be enclosed in a water-resistant wrapper. Even water-bearing explosives, known as water gels, which have a relatively high degree of water resistance and often are used in bulk form, preferably are cartridged for deep borehole loading. If a relatively fluid water gel explosive is simply dumped down the borehole, much of it may never reach bottom because it may stick to the walls of the borehole or dissolve in water on the way down. That which does reach bottom may be desensitized by admixture with water, and some may subsequently leak away through fissures in the rock. Also, water gel explosives that are sufficiently fluid to be pumped rapidly through a hose to great depths are likely to have insufficient viscosity to resist desensitization by water, and may leak away through fissures in the rock.

On the other hand, if an attempt is made to dump down a borehole a water gel which has a sufficiently high viscosity to resist desensitization by water, the explosive may bridge across the hole and never reach bottom. Or, even if it reaches bottom, it may fail to slump into a high-density load because of its high viscosity. Although it is possible to formulate water gel explosives so that they are very fluid while being pumped down a hose to the depths of a deep hole and then develop a high viscosity after being emplaced, the precise chemical control required in such a system is difficult to achieve consistently under field conditions. The use of cartridged water gels eliminates the problems caused by too high or too low a viscosity in the bulk explosive.

When conventional borehole loading procedures are employed to emplace explosive cartridges in boreholes, i.e., dropping or lowering the cartridges from the borehole collar, the borehole may become bridged by one or more cartridges before they have reached bottom, thereby blocking the hole causing a pile-up of cartridges above it. Such an occurrence, which, at the very least, adds greatly to the borehole loading time, becomes even more likely with boreholes of great depth, and also more difficult to remedy.

In addition to the above-described difficulties, other problems are encountered in cases in which the borehole has been chambered to permit the emplacement of a larger charge or if the composition of the charge is to be varied as a function of either vertical position in the hole or hole diameter. In such cases it is important to know the height of rise of the explosive load as a continuous function of the load emplaced, in order to confirm the size and shape of the chamber. Also, in response to this variable, it is often desired that the composition of the explosive being loaded by quickly changed, or loading be quickly cut off entirely.

Also, because of the large number of cartridges which may need to be emplaced in the borehole, it is important from the standpoint of economics that the loading method be as rapid as possible.

SUMMARY OF THE INVENTION

This invention provides a method of loading a borehole with explosive cartridges comprising:

a. providing a cartridge-guiding assembly comprising a length of flexible tubing, preferably having inwardly projecting cutting means, e.g., a knife blade, mounted thereon in the vicinity of one of its ends, e.g., mounted on the inner wall of an open-ended, preferably somewhat rigid cylindrical member, such as a nozzle, which is coaxially joined to one end of the length of tubing so as to form a continuous channel therewith;

b. feeding the cartridge-guiding assembly into a substantially vertical borehole until the leading end of the assembly, e.g., the end of the tubing at which cutting means is mounted or the free leading end of the cylindrical member, is positioned at a location, short of the bottom of the borehole, where explosive cartridges are to be discharged, thereby leaving the cartridge-discharge space in the borehole, the assembly extending through substantially the remainder of the borehole, i.e., to substantially the collar of the borehole, and being sufficiently heavy, at least at its leading end, so as to be dragged downward against frictional forces produced at the borehole wall and through any water which may be present in the borehole;

c. directing a stream of water through the assembly, i.e., through the tubing and, when present, the cylindrical member;

d. feeding explosive cartridges into the length of tubing whereby the cartridges travel through the tubing together with the stream of water, preferably are cut open by passage past a cutting means, and are discharged from the leading end of the assembly, e.g., from the free end of the cylindrical member, into the cartridge-discharge space adjacent thereto;

e. sensing the passage of the explosive cartridges through, or their discharge from, the assembly, e.g., by measuring electrical or pressure transients, or tension in the tubing, caused by the presence or motion of the cartridges;

f. retracting the cartridge-guiding assembly when the space adjacent thereto is filled, as evidenced by the cessation of cartridge discharge, whereby additional cartridge-discharge space is created;

g. creating a cartridge-feeding opening in the retracted length of tubing in the vicinity of the borehole collar; and h. repeating Steps (c), (d), (e), (f), and (g) as required until the desired number of cartridges have been discharged into the borehole.

Because deep boreholes are apt to be flooded with water and are expensive to drill, the explosive should have good water resistance and high energy per unit volume of loaded hole. For this reason, water gel explosives are preferred in the present process, in cartridged form while travelling through the guide assembly and thereafter released from the cartridges by cutting of the latter just prior to discharge from the assembly to allow the explosive to slump in the borehole to produce a high loading density. A preferred cartridge is a "chub," comprised of a tube of plastic film, filled with explosive, and gathered at both ends and closed, e.g., by means of closure bands around the gathered portions.

The present invention also provides apparatus for loading explosive cartridges into a borehole comprising:

a. a cartridge-guiding assembly comprising a length of flexible tubing and preferably inwardly projecting cutting means, e.g., a knife blade, mounted on the length of tubing in the vicinity of one of the tubing's ends, e.g., mounted on the inner wall of an open-ended, preferably somewhat rigid cylindrical member, such as a nozzle, which is coaxially joined to one end of the length of tubing so as to form a continuous channel therewith, the assembly (1) extending to a location inside, but short of the bottom of, a substantially vertical borehole from a location at the collar of, or outside, the borehole, the tubing end at which the cutting means, if present, is mounted, e.g., the cylindrical member, being in the foremost position, (2) being axially movable with respect to the borehole, and (3) having a stream of water flowing therethrough, i.e., through the tubing and, when present, the cylindrical member; and b. means, e.g., load-detecting means, associated with said cartridge-guiding assembly, for sensing the passage of explosive cartridges through, or their discharge from, the leading end of the assembly, e.g., from the cylindrical member.

In addition, means for detecting and displaying the output of the sensing means may be associated with the sensing means.

In a preferred method and apparatus, a length of tubing extends outside the borehole and is longitudinally slit open in the vicinity of the borehole collar. The explosive cartridges are fed, and the stream of water is directed, into the length of tubing through the slit-open portion. As the tubing is retracted from the borehole, the slit-open portion is extended to the vicinity of the borehole collar, or a new slit is created near the collar.

DETAILED DESCRIPTION

Figure 1:
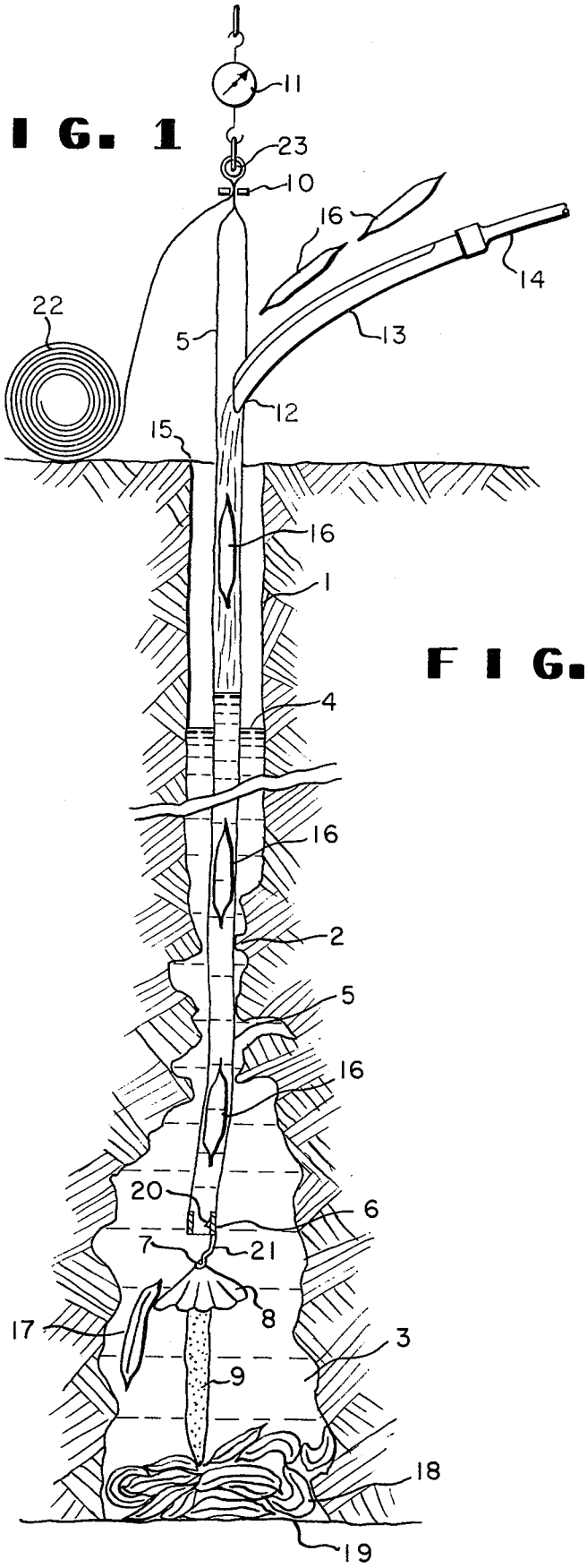
FIG. 1 is a schematic representation in elevation of a borehole being loaded with explosive cartridges by the apparatus and method of the present invention.

In the process of the invention, the loading of substantially vertical boreholes with explosive cartridges is accomplished at a rapid rate by the guided descent of the cartridges through a retractable tubing assembly through which a stream of water flows. The tubing provides a substantially uniform-diameter, smooth-wall passageway for the cartridges, thereby avoiding the problem of hole blockage due to cartridge hangup or bridging of the hole as may occur if the cartridges are dropped down rough-walled holes, possibly uneven in diameter. The stream of water washes the cartridges down the tubing, slowing them down and cushioning their fall while above the water table, and maintaining a flow of cartridges through the tubing assembly below the water table. Thus the cartridge-guiding assembly and water stream impart a degree of controllability to the borehole-loading process, a feature which is of greater importance with deeper boreholes.

The length of flexible tubing or hose is made of any material that is water-resistant and has sufficient flexibility to be handled conveniently in the length required for loading deep boreholes, e.g., several hundred to several thousand feet. As a practical matter, this means that the tubing will be adapted to be provided in folded or rolled-up form, from which it will be fed into the borehole. At the same time, the tubing should have a smooth inner wall, sufficient strength to withstand gross tearing which could result in the escape of cartridges through the walls of the tubing, and sufficient dimensional stability to preserve a substantially uniform cross-section throughout its length and thereby assure an uninterrupted cartridge descent therethrough.

The wall thickness of the tubing can vary depending on such factors as the strength of the tubing material and the diameter of the cartridges, a thinner wall being feasible with a stronger tubing material and a smaller-diameter cartridge. With many materials, the tubing wall thickness preferably is about from 0.1 to 0.7 percent of the cartridge diameter within the preferred cartridge diameter range of about from 1 to 6 inches (25.4 to 152 mm.), and optionally about from 0.3 to 0.4 percent of the cartridge diameter within the optimum cartridge diameter range of about from 1.5 to 3 inches (38 to 76 mm.), the lower end of the preferred thickness range being associated with the upper end of the preferred cartridge diameter range. In any case, the tubing wall thickness will be at least about 0.002 inch (0.051 mm.). There is no upper limit on the wall thickness so long as the desired flexibility of the tubing is maintained. Light-weight tubing is preferred, however, and therefore as a practical matter the tubing wall thickness usually will not exceed about 1 percent of the cartridge diameter. The inside diameter of the tubing is sufficient to allow easy passage of the cartridges to be used without providing so much clearance that the cartridges can override each other and jam, e.g., about 5–20 percent larger, but preferably about 10 percent larger, than the diameter of the cartridges. Naturally the outer diameter of the tubing has to be sufficiently small to permit insertion into and retraction from the borehole without deleterious abrasion of the tubing wall, or deformation from the approximately circular cross-section required to permit passage of the cartridges.

The tubing can be made of any material that will provide the necessary flexibility, strength, and dimensional stability in the selected wall thickness. Plastics and rubber, optionally laminated and/or reinforced with filaments such as metal or textile threads, can be used, for example.

In order that the tubing may be more easily handled in the long lengths required, it is preferred that it be as light in weight as possible. Light-weight tubing also is desirable if a load-detecting means is to be used to sense cartridge discharge from the assembly. For this reason, plastic tubing is preferred. Polymers such as polyethylene, polypropylene, plasticized polyvinyl chloride, polyvinylidene chloride, and polyethylene terephthalate can be employed, for example. Especially preferred is "Valeron" film, comprising two bonded cross-lapped sheets of oriented polyethylene film, which affords high strength, tear resistance, and dimensional stability in the form of thin-wall tubing, e.g., tubing having a wall thickness of about 0.003 to 0.006 inch (0.076 to 0.152 mm.).

The length of flexible tubing preferably has inwardly projecting cutting means mounted thereon in the vicinity of one of its ends. The purpose of the cutting means is to cut open the cartridges near their point of discharge from the assembly so that they are in a split-open condition when discharged into the borehole. This allows the explosive to fill in the voids which would otherwise exist between cartridges and thereby achieve a higher density. The preferred water gel explosives can be formulated to have a sufficiently high viscosity and sensitivity to afford good performance under high water pressure and still permit the slit cartridges to slump readily to a dense mass.

The cutting means, e.g., one or more slitting blades, can be mounted directly in the tubing wall, e.g., by insertion of a supported blade through the wall of a tube which is sufficiently firm to hold the blade in position and taping of the externally protruding blade support in place. With the preferred thin, light-weight plastic tubing, the cutting means can be mounted on the inner wall of an open-ended, preferably somewhat rigid cylindrical member, e.g., a nozzle or ring, which is coaxially joined to one end of the length of tubing so as to form a continuous channel therewith. The cutting means should be located no farther than ten, and preferably no farther than two, tubing diameters from the end of the tubing, e.g., the end of the cylindrical member, which is the discharge end of the assembly.

Preferred materials of construction for the cylindrical member are stainless steel or engineering plastics such as nylon, polyvinyl chloride, polycarbonate resin, or polyethylene. The cylindrical member can be joined to the tubing by any convenient method, e.g., force fit, clamping, etc. In a preferred method the outer diameter of an end of the cylindrical member is tapered down, the end of the tubing is slipped over the untapered end, and tight tape or banding is then put over the tubing-covered tapered portion of the cylindrical member. Likewise, the cutting blade can be mounted to the wall of the cylindrical member by any convenient method, e.g., by welding when a metal cylindrical member is used.

The cartridge-guiding assembly is sufficiently heavy, at least at its leading end, so as to be dragged downward in the borehole against the frictional forces produced at the borehole wall and so as to overcome the net upward buoyancy of any parts of the tubing which may be submerged in water in the borehole. With heavier tubing, the assembly may be sufficiently heavy of its own accord. However, to facilitate the passage of the tubing through constricted and possibly tortuous portions of the borehole, a weight preferably is secured to the leading end of the assembly, e.g., as shown in FIG. 1. Also, in the preferred assembly wherein the length of tubing is lightweight and buoyant in water, the assembly will be made heavy at its leading end by the attachment of a weight thereto. Usually a weight sized so as to provide a net downward drag of about from 1 to 20 pounds (0.4 to 9.1 kg.), when the tube is empty of cartridges and as felt at the borehole collar, is satisfactory.

The cylindrical member (e.g., nozzle), if suitably dense, can be suitable to weight the assembly, but preferably the weight is a deformable elongated member suitably suspended from the leading end of the tubing. Such a weight will be somewhat flexible and slithery to ease its descent and that of the entire cartridge-guiding assembly through uneven boreholes where localized constrictions could cause blockages to occur with rigid weights.

The method of loading explosive cartridges into a borehole according to the present invention by use of the apparatus of the invention will now be described with reference to FIG. 1 in which 1 is a substantially vertical borehole having a collar 15 and bottom 19. The diameter of borehole 1 is non-uniform, a constricted section of borehole being indicated by 2. The lower end of borehole 1 consists of cavity 3, a larger-diameter section of borehole produced by a springing or reaming procedure. Water is present in borehole 1 up to a level indicated by 4. The length of borehole 1 is, for example 465 feet (142 meters), and its diameter in the upper unconstricted portion thereof is 6 inches (152 mm.).

An assembly for guiding cartridges into borehole 1 comprises (a) a length of flexible tubing 5, e.g., made of a dimensionally stable polymer such as Valeron, coaxially joined, by tight taping 61 (FIG. 2), at one end to open-ended cylindrical member 6, e.g., a short rigid nozzle made, for example, of stainless steel, so as to form a continuous channel with tubing 5, and (b) cutting means 20, e.g., a knife blade, mounted to the inner wall of cylindrical member 6. The cartridge-guiding assembly has been positioned in borehole 1 with cylindrical member 6 in the foremost position, the leading end of cylindrical member 6 constituting the cartridge-discharge end of the assembly and being located short of the bottom 19 of borehole 1, leaving a cartridge-discharge space therein. Tubing 5 is 500 feet (153 meters) long, its inner diameter is 1.75 inches (44.4 mm.), and its wall thickness 0.006 inch (0.152 mm.).

Weight 9, secured to the leading end of the cartridge guiding assembly, is a deformable elongated member such as a cylinder coaxially suspended below cylindrical member 6. The weight is pivotably attached to one end of rod 21 at swivel 7, the other end of the rod being rigidly attached to the free end of cylindrical member 6. The shaft of rod 21 is inclined to the axis of cylindrical member 6 so as to provide an attachment for weight 9 that is on or near the axis of cylindrical member 6 but that does not interfere with the exiting of cartridges from the cylindrical member. Hanging the weight by swivel 7 allows the weight to pivot freely relative to cylindrical member 6, thereby preventing the flexible tubing 5 from becoming twisted. Weight 9 weighs about 10 pounds and is in the form of a long thin cylinder, e.g., a thin-walled rubber tube filled with dense fluid such as a dense slurry of red iron oxide, barium sulfate, ferrophosphorus, or ferrosilicon powder, or lead shot, suspended in water gelled with cross-linked polyacrylamide or guar gum. The slithery, flexible nature of weight 9 allows it to pass more readily through constricted borehole sections, e.g., the section denoted by 2.

Secured to the top of cylindrical weight 9 is a cover disk 8, e.g., a thin, flexible elastomeric disk having radial slits extending from its edge part of the way to its center. Disk 8 has a radius which is about from ½ to 2 inches longer than the distance from the center of the disk to the edge of cylindrical member 6 so that the disk can push member 6 away from obstructions and can also fold over the edge of member 6 as it is lowered through borehole 1 to prevent member 6 from being caught on obstructions, but can thereafter fall away from the edge of member 6 so that the mouth of the latter will not be obstructed as cartridges are to be discharged therefrom. Preferably, cylindrical member 6 is no longer than about three times its diameter so that it can more easily move up and down through curved and constricted sections of borehole.

Tubing 5 is fed into borehole 1 from reel 22 on which it is wound in flattened form. The flattened tubing from reel 22 loops around roller 23 and is held thereon by clamp 10. Associated with the cartridge-guiding assembly is cartridge-discharge-sensing means 11, in this case a spring balance. Roller 23 is suspended from spring balance 11, hung from a tripod (not shown). Thus the portion of tubing 5 below clamp 10 is supported in axial position with the borehole. Weight 9 assists the movement of the assembly down through the borehole.

A cartridge-insertion means comprising flume 13 communicates with tubing 5 at a location in the vicinity of borehole collar 15. Flume 13 is a tilted chute having a downward-curving spillway and a total length at least about twice the length of the carridge to be inserted. (The length of flume 13 can be equal to the cartridge length to accommodate inserting one cartridge at a time, or to two or more cartridge lengths depending on the number of cartridges one wishes to emplace substantially simultaneously.) The lower end of flume 13 is inserted into slit 12 in the wall of tubing 5 outside borehole 1 near collar 15. Water is run into the upper end of flume 13 through hose 14 attached thereto.

Two explosive cartridges 16 are about to be fed into a running stream of water in flume 13. The cartridges are chub film cartridges filled with a slumpable water gel explosive, and have a diameter, for example, of 1.5 inches (38 mm.). The water carries the cartridges down flume 13 and into tubing 5. Other cartridges 16 are moving through tubing 5 in the water stream therein, and slit cartridge 17 has been discharged from the assembly and is shown dropping to the bottom of the borehole. A load of slit cartridges 18 is building up and slumping in the sprung portion of borehole 1. Although the cartridges are slit open, the presence of the cartridge film wrapping minimizes the leakage of explosive through surrounding fissures.

The exit of the cartridges from cylindrical member 6 and possible blockages due to the buildup of cartridges in tubing 5 are monitored by observing the tension recorded on spring balance 11 (or an equivalent load detector). The depth to which this type of sensing means can be used depends on the friction of the tube against the borehole wall and therefore on both the roughness and verticality of the hole. This type of sensing means may be useful for boreholes as deep as about 1000 feet (305 m.) or more.

After the level of the slit cartridges in the borehole has reached cylindrical member 6, the cartridge-guiding assembly, i.e., tubing 5, is retracted to create additional cartridge-discharge space. To avoid extremely long cartridge drops with the cartridge slit and without the protection of the guiding tube, this retraction generally is performed in increments, with each retraction bringing the leading end of the assembly no more than about 100 feet (30.5 m.), and preferably no more than about 30 feet (9.2 m.), above the load of slit cartridges.

Tubing 5, which is initially positioned so that the free end of cylindrical member 6 is typically about 15 feet (4.6 m.) from the bottom of borehole 1, is now retracted about 15 feet (4.6 m.). Depth markings applied down the side of tubing 5 are useful for a more rapid determination of the length of tubing fed into and retracted from the borehole. Inasmuch as the retraction moves slit 12 and flume 13 as well, it is convenient either to extend slit 12 toward borehole collar 15 or to make a new slit near the collar, and to insert flume 13 in the new slit or in the extension. The steps of feeding cartridges into the assembly, sensing their discharge therefrom, then sensing the cessation of discharge and the buildup of undischarged cartridges when load 18 builds up to block the exit of cylindrical member 6, and then retraction are repeated until the desired number of cartridges have been discharged into the borehole. At that time, the entire cartridge-guiding assembly is removed from the borehole.

The explosives initiation technique known as multiple priming, wherein a number of explosive primers are positioned throughout a charge in a borehole with spacings between them, can be used advantageously with the charge loaded by the present method. For example, a string of spaced primers, adapted to be detonated either by detonating cord or electrical blasting caps, can be lowered into the borehole along with the cartridge-guiding assembly. The cartridges are discharged with the primers in place and amass around the primers, and final removal of the cartridge-guiding assembly leaves the primed charge in the borehole.

When the cartridge-guiding assembly is in position for cartridge-discharging in the borehole, the length of tubing extends at least up to the borehole collar, i.e., to the mouth of the borehole, but preferably beyond the collar. The latter case is preferred not only because the tubing is more easily secured if it extends outside the borehole, but also because the wall of the portion of tubing outside the borehole can be slit open near the collar to allow faster cartridge insertion than can be accomplished through the exposed end of tubing whose diameter does not greatly exceed that of the cartridges.

If the tubing has a thin flexible wall, as preferred, it can easily be provided with a longitudinal slit in the portion outside the borehole, e.g., within about one foot of the collar, and, as described above, the slit extended toward the borehole collar with each retraction or a new slit made near the collar in the portion emerging from the borehole with each retraction. Alternatively, the tubing can be provided with an interlocking longitudinal seam adapted to be opened and closed repeatedly by a slide device, e.g., zipper tubing. Such tubing can be handled conveniently in the flat, unzipped condition, wound up on a reel from which it can be fed into the borehole by unwinding the unzipped tubing and zipping it closed as it is fed in so that the tubing wall is closed in the borehole up to the collar thereof. Outside the borehole the tubing remains unzipped to allow cartridge insertion. Each time the cartridge-guiding assembly is retracted, a portion of zipped tubing emerges from the borehole and this can be longitudinally opened up by unzipping substantially to the borehole collar to facilitate continued cartridge insertion. Because zipper tubing can be opened and closed repeatedly, it is reusable for loading more than one borehole without repairing slits made in the walls as is usually required when conventional tubing is reused.

The cartridges and water stream can be introduced into the tubing separately, e.g., by using a hose in the slit-open portion of the tubing to introduce the water and feeding the cartridges through the same or another slit. The flume technique described above, or a technique analogous thereto, is preferred, however, since entrainment of cartridges in the water stream outside the borehole increases the loading speed.

Using the loading method shown in FIG. 1, chub cartridges can be loaded into 465 feet (142 meters) deep holes at a rate of about 2500 cartridges per hour.

When the load of cartridges emplaced builds up to the extent that cartridge discharge and flow through the tubing stops, and the assembly is retracted, the cartridges could become seized in the tubing and it may be difficult to resume cartridge flow. This problem can be avoided by perforating the bottom portion of the tubing, e.g., at least about the bottom 100 feet (30.5 m.) of tubing, using, for example, about 0.125-inch (3.175 mm.) holes. Use of a pair of opposed holes about every foot (30.5 cm.) or so is suitable. This procedure prevents a vacuum from forming between the cartridges as a result of differences in their starting velocities, and the consequent seizing thereof. Such holes or perforations are denoted by the numeral 62 in FIG. 2.

An important feature of the present process is the sensing and detection of the passage of the cartridges through, or their discharge from, the cartridge-guiding assembly. This feature provides information on whether the cartridges are being discharged or whether the flow has ceased due to blockage, e.g., by the build-up of cartridges in the borehole; and, together with measurements of the depth of the assembly before and after each retraction, permits an estimate to be made of the height of rise of the explosive load in the borehole as a continuous function of load emplaced. In this manner, one can determine the diameter of the borehole throughout its length and, if desired, change the composition of the explosive as a function of diameter or as a function of vertical position. The determination of the borehole diameter at different depths by this technique is especially useful when the boreholes have been chambered (i.e., expanded in order to accommodate a larger explosive charge), or if the borehole walls are unstable, inasmuch as an irregular diameter is apt to result in such cases.

The passage of individual cartridges through the lower end of the assembly can be sensed in various ways, using, for example, pressure, optical, or electrical transients caused by the presence or motion of the cartridges. For boreholes up to about 1000 feet deep, a load-detecting means such as that shown in FIG. 1 may be suitable, the load changing with the discharge of each cartridge. For deeper boreholes, an electrical transient measurement method is preferred. For example, the AC electrical resistance between two points near the inner wall of the cylindrical member, below the slitting knife, can be sensed. This resistance is high when no explosive cartridge is bridging the electrodes and is low when a slit cartridge is bridging them. Electrodes immersed in typical water gel explosive compositions are polarized by DC voltages, thus preventing clear detection of the presence or absence of an explosive cartridge. The use of AC voltages avoids this problem and AC frequencies of 60 Hz or more are satisfactory frequencies at which to detect changes in resistance caused by the passage of cartridges. A cartridge-slitting knife within the cylindrical member and an electrode downstream from the knife make a satisfactory pair of electrodes for the resistance-sensing procedure.

In a preferred embodiment, the passage of cartridges through the lower end of the assembly is sensed by measuring the inductance change in a wire coil coaxially mounted at the forward end of the tubing assembly. A material having high magnetic permeability, e.g., iron, magnetic iron oxide, or chromium dioxide, is located in each cartridge, e.g., in the explosive composition, in the packaging material enclosing it, or in a closure clip (an iron closure clip on a chub cartridge, for example). When the cartridge passes through the coil, the inductance of the coil changes, and is sensed and displayed by an inductance-monitoring circuit located outside the borehole and joined by wires to the coil. Preferably, the material of high permeability in each cartridge is contained in a single small locality, i.e., in a single iron clip on one end of the package so that the passage of each package produces only one pulse in the inductance-monitoring circuit.

Figure 2:
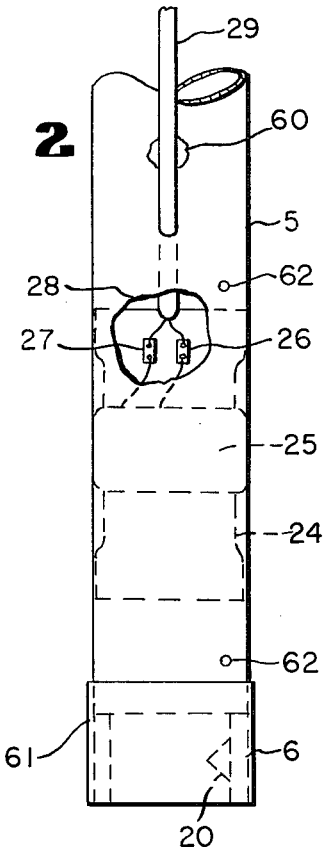
FIG. 2 is a schematic representation in elevation of a portion of the apparatus of the invention wherein the means for sensing the passage of cartridges includes a wire coil whose inductance is changed by the passage of cartridges therethrough.

In FIG. 2, a 700-turn coil 25 of No. 34 copper wire is wound around the recessed portion of a spool-like, thin-walled plastic, hollow coil form 24. Coil 25 has an outer diameter of 1.75 inches (45.4 mm.), and a height of 0.75 inch (19 mm.). The inner diameter of coil form 24 at the recessed portion is sufficiently large to allow the cartridges to pass through, and the largest outer diameter of the coil form is 1.75 inches (45.4 mm.). Coil form 24 is held in position in tubing 5 about a foot (30.5 cm.) above cylindrical member 6 by force fit. Metal tabs 26 and 27 are attached to the outer wall of coil form 24 by any suitable procedure. A temporary hole 28 in the wall of tubing 5 permits one end of the wire which forms coil 25 to be soldered to metal tab 26 and the other end to metal tab 27. One end of one of the two 24-gage copper wires in insulated duplex wire 29 is also soldered to metal tab 26, and one end of the other of the two wires to metal tab 27. Coil 25, tabs 26 and 27, and the exposed portions of the wires are protected with a coating of a water-proofing agent, and a patch is placed over hole 28. Duplex wire 29, preferably affixed to the outer wall of tubing 5, e.g., by intermittent applications of hot-melt adhesive 60, extends to the surface where it is connected to an inductance-monitoring circuit such as that shown in FIG. 3.

Figure 3:
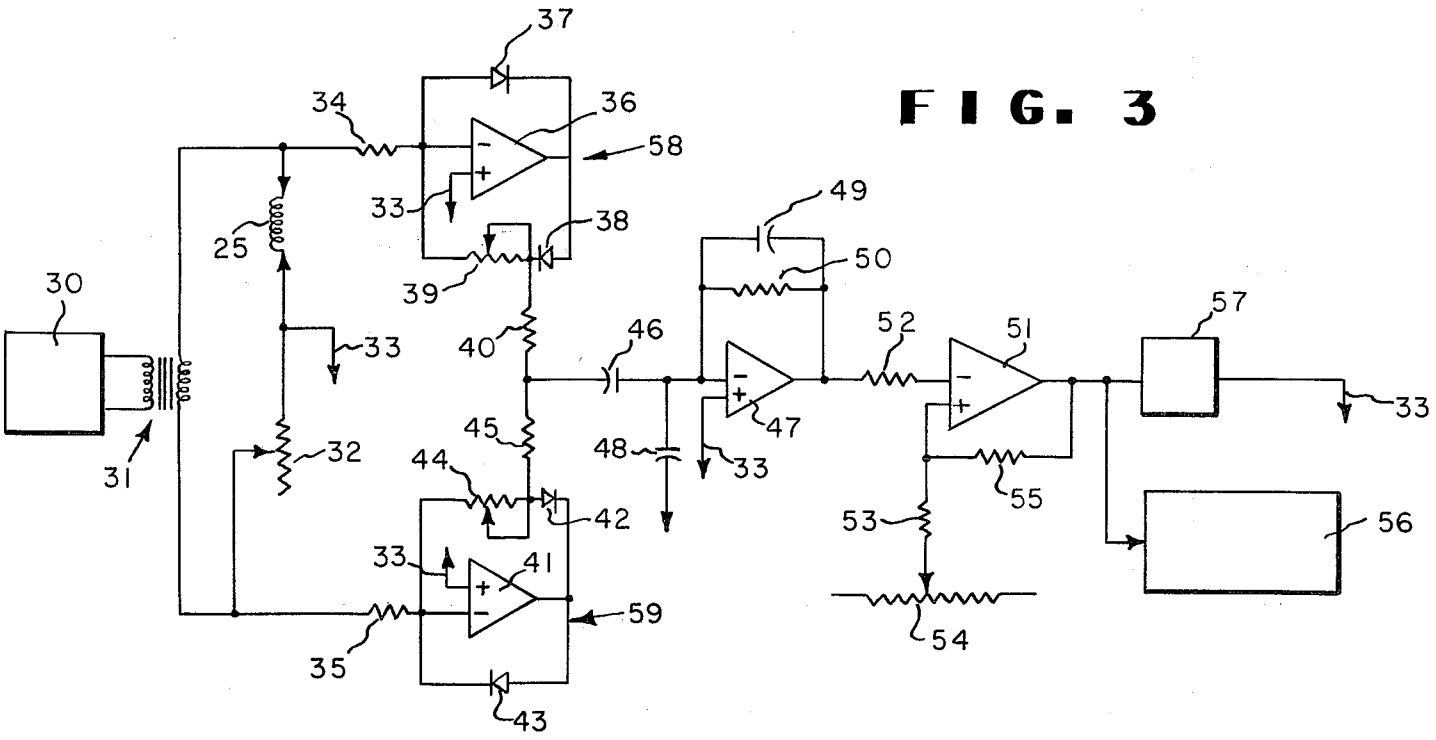
FIG. 3 is a diagram of an inductance-monitoring circuit for use with the apparatus shown in FIG. 2.

Referring to FIG. 3, oscillator 30 generates approximately one volt a.c. at a frequency of one kilohertz. This furnishes power through coupling transformer 31 to the series combination of coil 25 and adjustable resistor 32, one of the conductors of duplex wire 29 at the surface being connected to the junction of transformer 31 and resistor 34, and the other to adjustable resistor 32. This junction of coil 25 and resistor 32 is connected to the circuit common 33, which preferably is also the circuit ground.

The voltages referenced to circuit common 33 appearing across coil 25 and adjustable resistor 32 are applied to precision rectifier circuits 58 and 59 through resistors 34 and 35, respectively, with the outputs of the two rectifier circuits joined through summing resistors 40 and 45.

Precision rectifier circuit 58 is composed of amplifier 36, diodes 37 and 38, and feedback resistor 39 connected so as to linearize the rectifier characteristic of diode 37, i.e., force the circuit to behave as an ideal rectifier element. Such a circuit is known in the art, and is more fully described in the *Handbook of Operational Amplifier Applications*, Burr-Brown Research Corporation, Tucson, Arizona, Ed. 1, 1963, page 70. Similarly, precision rectifier circuit 59 is composed of amplifier 41, diodes 42 and 43, and feedback resistor 44, and is arranged to rectify the negative-going half-cycle of the applied voltage, with reference to circuit common 33, while circuit 58 rectifies the positive-going half-cycle.

The junction of resistors 40 and 45 is connected through capacitor 46 to provide AC coupling to amplifier 47, whose gain and frequency response is determined by capacitors 46, 48, and 49, and resistor 50. In particular, capacitor 48, in conjunction with resistors 40 and 45, serves as a filter, eliminating the AC component of the summation of the rectified voltages appearing at the junction of resistors 40 and 45.

The output of amplifier 47 drives a voltage level detector, consisting of amplifier 51 and resistors 52, 53, 54, and 55, with the triggering threshold determined by the value of variable resistor 54. The level detector circuit is essentially a biased amplifier, as is more fully described in the aforementioned handbook, page 46.

In operation, the circuit is adjusted to a balanced condition throughout in the quiescent state, i.e., with no ferromagnetic material within coil 25. Adjustable resistor 32 is used to balance the circuit so that the voltage across coil 25 is equal to the voltage across resistor 32. Similarly, variable resistors 39 and 44 are adjusted to provide equality in the precision rectifier circuits, as denoted by zero voltage from the junction of resistors 40 and 45 to the circuit common 33. Also, resistors 39 and 44 are further adjusted to provide maximum attainable amplification in rectifiers 58 and 59, respectively, limited only by amplifier saturation and the above-mentioned equality requirement.

The cartridge whose passage is to be detected contains a material having high magnetic permeability. For example, the ends of a chub cartridge are closed with an iron clip at one end and an aluminum clip at the other so that only one signal is obtained from each cartridge. When such a cartridge passes through coil 25, the latter's inductance and impedance change because of the presence of the ferromagnetic material (iron) within its field of influence, thus changing the voltage drop across coil 25. This causes an imbalance in the circuit such that the positive rectified voltage no longer is equal to the negative rectified voltage, and the difference appears at the junction of resistors 40 and 45, with relation to circuit common 33. This transient difference voltage, after filtering, is amplified in amplifier 47, and in turn actuates the voltage level detector, thus providing a signal which may be fed to a counter and visual display means 56 and also to an acoustic signaling means 57.

We claim:

1. Method of loading explosive cartridges into a borehole comprising:

a. providing a cartridge-guiding assembly comprising a length of flexible tubing;

b. feeding said assembly into a substantially vertical borehole until the leading end of said assembly is positioned at a location, short of the bottom of the borehole, where explosive cartridges are to be discharged, thereby leaving a cartridge-discharge space in the borehole, said assembly extending through substantially the remainder of the borehole, and being sufficiently heavy, at least at its leading end, so as to be dragged downward against the frictional forces produced at the borehole wall and through any water which may be present in the borehole;

c. directing a stream of water through said assembly;

d. feeding explosive cartridges into said length of tubing whereby said cartridges travel through said tubing together with said stream of water and are discharged from the leading end of said assembly into the cartridge-discharge space adjacent thereto;

e. sensing the passage of said explosive cartridges through, or their discharge from, said assembly;

f. retracting said assembly when the space adjacent thereto is filled, as evidenced by the cessation of cartridge discharge, whereby additional cartridge-discharge space is created;

g. creating a cartridge-feeding opening in said retracted length of tubing in the vicinity of the borehole collar; and h. repeating Steps (c), (d), (e), (f), and (g) as required until the desired number of cartridges have been discharged into the borehole.

2. A method of claim 1 wherein inwardly projecting cutting means is mounted on said length of tubing in the vicinity of the end thereof which is at said assembly's leading end, and said cartridges are cut open by passage past said cutting means.

3. A method of claim 2 wherein the passage of the cartridges through said assembly is sensed by measuring the electrical resistance change caused thereby.

4. A method of claim 1 wherein a portion of said length of tubing extends outside the borehole and is longitudinally slit open in the vicinity of the borehole collar, said explosive cartridges being fed, and said stream of water being directed, into said length of tubing through said slit-open portion.

5. A method of claim 4 wherein, after retraction of said assembly, said slit-open portion of said length of tubing is extended so as to reach the vicinity of the borehole collar.

6. A method of claim 4 wherein a new slit-open portion is created in said retracted length of tubing in the vicinity of the borehole collar.

7. A method of claim 4 wherein said explosive cartridges are fed into a stream of water in a flume, said flume having a downward-curving spillway and its lower end inserted in the slit-open portion of said length of tubing, whereby the cartridges are carried down the flume and into the cartridge-guiding assembly.

8. Apparatus for loading explosive cartridges into a borehole comprising:

a. a cartridge-guiding assembly comprising a length of flexible tubing, said assembly (1) extending to a location inside, but short of the bottom of, a substantially vertical borehole from a location at the collar of, or outside, said borehole, (2) being axially movable with respect to said borehole, and (3) having a stream of water flowing therethrough; and b. means associated with said cartridge-guiding assembly, for sensing the passage of explosive cartridges through, or their discharge from, the leading end of said assembly.

9. Apparatus of claim 8 wherein said tubing is made of a dimensionally stable polymer.

10. Apparatus of claim 8 wherein a portion of said length of tubing extends outside the borehole and is longitudinally slit open in the vicinity of the borehole collar for feeding explosive cartridges and directing a stream of water into said length of tubing.

11. Apparatus of claim 8 wherein separated small perforations are present in the wall of the lower portion of said length of tubing.

12. Apparatus of claim 8 wherein inwardly projecting cutting means is mounted on said length of tubing in the vicinity of the end thereof which is at said assembly's leading end.

13. Apparatus of claim 12 wherein an open-ended cylindrical member is coaxially joined to one end of said length of tubing so as to form a continuous channel therewith, and said cutting means is mounted on the inner wall of said cylindrical member.

14. Apparatus of claim 8 wherein said means for sensing the passage or discharge of explosive cartridges is a load-detecting means from which said cartridge-guiding assembly is suspended.

15. Apparatus of claim 14 wherein said load-detecting means is a spring balance.

16. Apparatus of claim 8 wherein cartridge-insertion means communicates with said length of tubing at a location in the vicinity of the borehole collar, said cartridge-insertion means comprising a flume having a downward-curving spillway and its lower end inserted in said length of tubing whereby cartridges are adapted to be fed into the stream of water in said flume and carried into said cartridge-loading assembly.

17. Apparatus of claim 16 wherein the lower end of said flume is inserted in a slit-open portion of said length of tubing outside the borehole.

18. Apparatus of claim 8 wherein a weight is secured to the leading end of said cartridge-guiding assembly.

19. Apparatus of claim 18 wherein said weight is an elongated deformable member coaxially suspended from said assembly and secured thereto.

20. Apparatus of claim 18 wherein water is present in the borehole, said tubing is buoyant, and said weight is sufficient to overcome the buoyancy of any part of the tubing that is submerged in water.

21. Apparatus of claim 20 wherein said weight is sized to give a net downward drag on the assembly, when empty of cartridges and when felt at the borehole collar, of about from 1 to 20 pounds.

22. Apparatus of claim 21 wherein said weight is a sealed elastomeric tube filled with a dense fluid.

23. Apparatus of claim 21 wherein said weight is pivotably attached to one end of a rod having its other end rigidly attached to said cylindrical member, said rod having its shaft inclined to the axis of said cylindrical member.

24. Apparatus of claim 23 wherein a flexible, radially slit elastomeric disk is secured to the top of said weight.

* * * * *